US005119350A

United States Patent [19]

Delacrétaz et al.

[11] Patent Number: 5,119,350

[45] Date of Patent: Jun. 2, 1992

[54] TIMEPIECE IN WHICH THE ARBOR FOR ONE OF THE HANDS BEARS A DECORATIVE PATTERN

[75] Inventors: Charles-Henri Delacrétaz; Yves Meystre, both of Granges, Switzerland

[73] Assignee: ETA SA Fabriques d'Ebauches, Granges, Switzerland

[21] Appl. No.: 798,106

[22] Filed: Nov. 26, 1991

[30] Foreign Application Priority Data

Dec. 4, 1990 [CH] Switzerland ..... 03817/90

[51] Int. Cl.[5] ..... G04B 19/00; G04B 29/00

[52] U.S. Cl. ..... 368/223; 368/322

[58] Field of Search ..... 368/76, 80, 223, 228–233, 368/285, 322

[56] References Cited

U.S. PATENT DOCUMENTS

| | | | |
|---|---|---|---|
| 1,310.038 | 7/1919 | Stewart . | |
| 2,536.206 | 1/1951 | Newhouse | 58/126 |
| 2,636,283 | 4/1953 | Dinstman | 33/222 |
| 4,558,952 | 12/1985 | Kulesh et al. | 356/349 |
| 4,693,613 | 9/1987 | Ritchie | 368/238 |
| 4,734,895 | 3/1988 | Grosskopf | 368/223 |
| 4,899,324 | 2/1990 | Barbieri et al. | 368/223 |

FOREIGN PATENT DOCUMENTS

| | | |
|---|---|---|
| 1020471 | 5/1958 | Fed. Rep. of Germany . |
| 1911488 | 7/1964 | Fed. Rep. of Germany . |
| 1271241 | 7/1961 | France . |
| 658969 | 12/1986 | Switzerland . |
| 2118334 | 10/1983 | United Kingdom . |

*Primary Examiner*—Vit W. Miska

*Attorney, Agent, or Firm*—Griffin Branigan & Butler

[57] ABSTRACT

A timepiece including a decorative pattern (30) rotating with the arbor (8) for one of the hands under a first crystal (1). In order to avoid permanent deformation of the arbor brought about by shocks, the decorative pattern is surrounded by a protective wall (11) which may be in the form of a bore in a second crystal (2) located between the first crystal and the dial (5) of the watch.

5 Claims, 2 Drawing Sheets

TIMEPIECE IN WHICH THE ARBOR FOR ONE OF THE HANDS BEARS A DECORATIVE PATTERN

This invention relates to an analog display timepiece provided with hands rotating between a dial and a first crystal and a decorative pattern fixed to an arbor for the hands and rotating therewith, said arbor emerging from said dial under said first crystal, said pattern exhibiting a substantially circular periphery located in a plane parallel to the dial.

BACKGROUND OF THE INVENTION

Patent document CH-A-658 969 has already described a watch with a moving ornament and its assembly method. This watch is ornamented by means of a set stone secured to the arbor of one of the hands. The stone is set by folding back claws forming a portion of a setting fixed to the arbor of the hand.

Another heavier and more complicated arrangement is proposed by the patent document U.S. Pat. No. 2,536,206 in which a diamond is pressed in a setting rotating with the minutes hand.

None of the holders of the cited documents has seen fit to enquire as to whether the described arrangement would be resistant to shocks which can occur during wearing of the timepiece. The owner of the present application wishing to place on the market such an arrangement, furthermore known from the cited documents, has subjected timepieces to standardized tests—thus shocks—which precede generally the release for sale of the finished product. It has noted after these tests (for instance a shock resulting from an acceleration of 5000 g in the direction of the axis of the time setting stem) that the axis of the hand supporting the decoration was bent in a permanent manner. Since it is scarcely possible to reinforce the arbor supporting the decoration, it has remedied the cited difficulty in proposing a fixed protective wall arranged with clearance around the periphery of the decoration in order to limit the displacement thereof when a shock is applied to the timepiece.

The invention will now be understood from the following description and the drawings which illustrate it, given by way of example.

DESCRIPTION OF THE PREFERRED EMBODIMENTS

Figure 1:
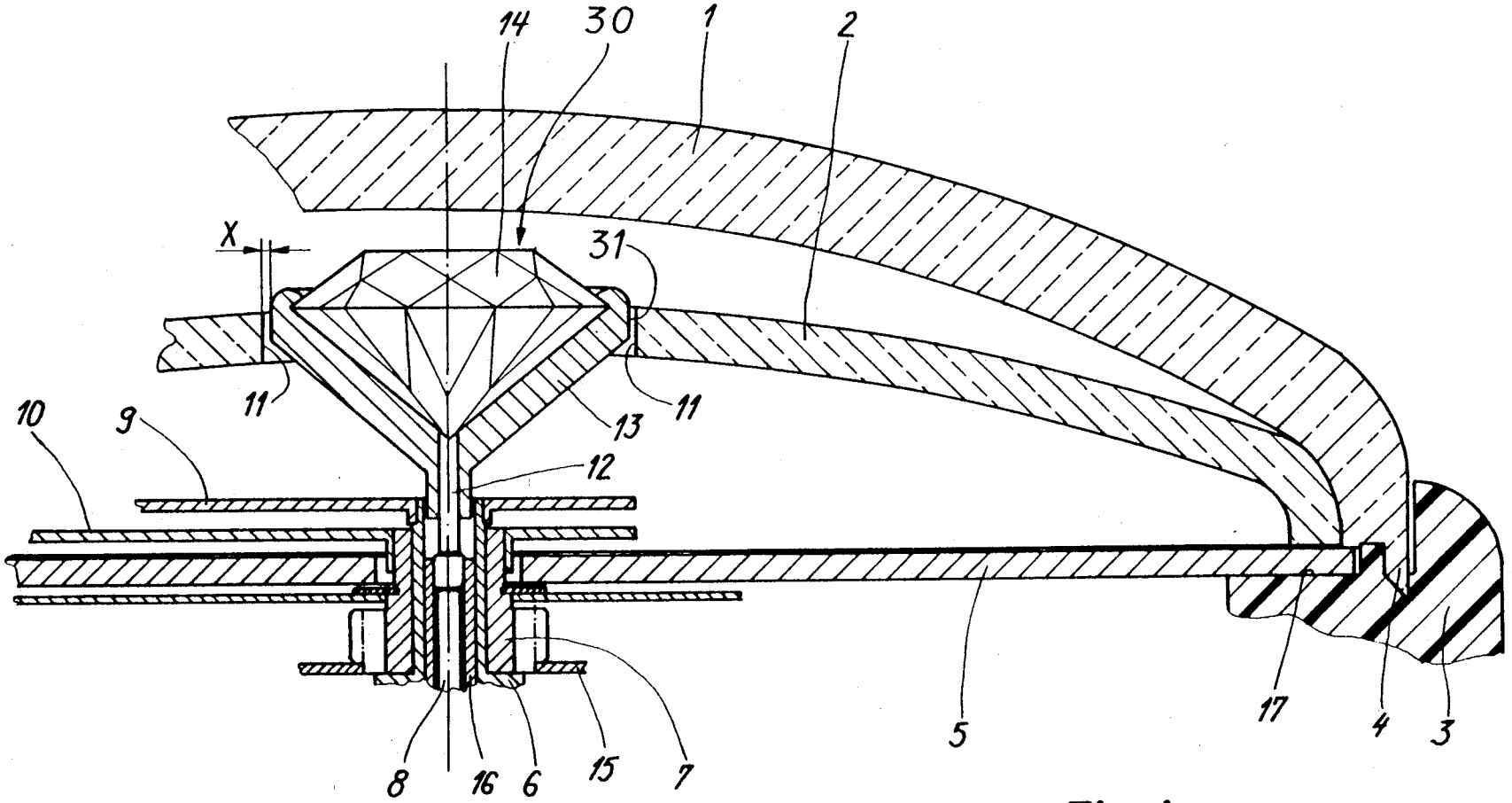
FIG. 1 is a cross-section taken through a timepiece of the invention according to a first embodiment thereof.

FIG. 1 shows a first embodiment which is also that which is preferred. The timepiece, which is here a wristwatch, is provided with a minutes hand 9 and hours hand 10 driven in rotation between a dial 5 and a first crystal 1. The hours hand 10 is fitted onto a cannon wheel 7 on which is driven the hours wheel 15 and the minutes hand is fitted onto the cannon pinion 6 as is the case in a standard assembly. A decorative pattern 30 is fixed to an arbor of one of the hands, here the seconds arbor 8, and turns with such arbor. As is also shown on FIG. 1, arbor 8 emerges from dial 5 by its end 12 under the first crystal 1. The decorative pattern 30 exhibits a substantially circular periphery 31 located in a plane parallel to the dial 5. The invention consists in arranging, with clearance x, a fixed protective wall 11 around the periphery 31 in order t limit the displacement of the pattern when a shock is applied to the watch.

In the embodiment of FIG. 1, the protective wall 11 is a bore formed in a second crystal 2 arranged between dial 5 and the first crystal 1. This drawing shows an example of securing of the first crystal 1 and the second crystal 2 onto the caseband 3 of the watch. Such caseband exhibits a shoulder 17 on which the dial 5 rests. In order to maintain such dial in place, crystal 1 is brought to bear thereon at the same time as such crystal is welded to the caseband by ultrasonic means as is described in patent document EP-B-0 101 663 (=U.S. Pat. No. 4,558,957). Following fitting of dial 5, but prior to welding of crystal 1, the crystal 2 is placed on the dial which is held in place as soon as crystal 1 is welded onto caseband 3.

Here the decorative pattern 30 is a faceted stone 14 driven into a setting 13, this latter being fitted onto the end 12 of the seconds arbor 8. The stone may be a diamond or any other precious stone. Such could also be a precious metal, gold for example. The clearance x between the wall 11 and periphery 31 of the decoration must be sufficiently great to assure easy assembly of the watch, but limited however in its dimension in order that, when a shock is exerted on the watch, the periphery 31 of the decoration 30 comes into contact with wall 11 before the elastic limit of the seconds arbor 8, 12 is exceeded (some tenths of a millimeter).

Figure 2:
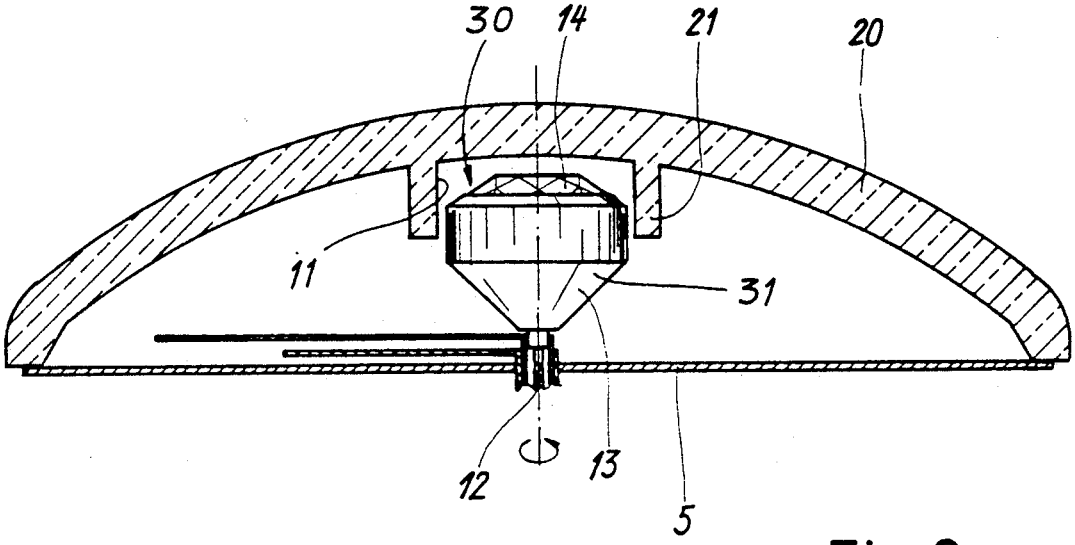
FIG. 2 shows a second embodiment of the invention.

FIG. 2 shows a second embodiment of the invention in which the protective wall 11 is formed by a tube 21 arranged under the first crystal 20 and preferably integral therewith.

Figure 3:
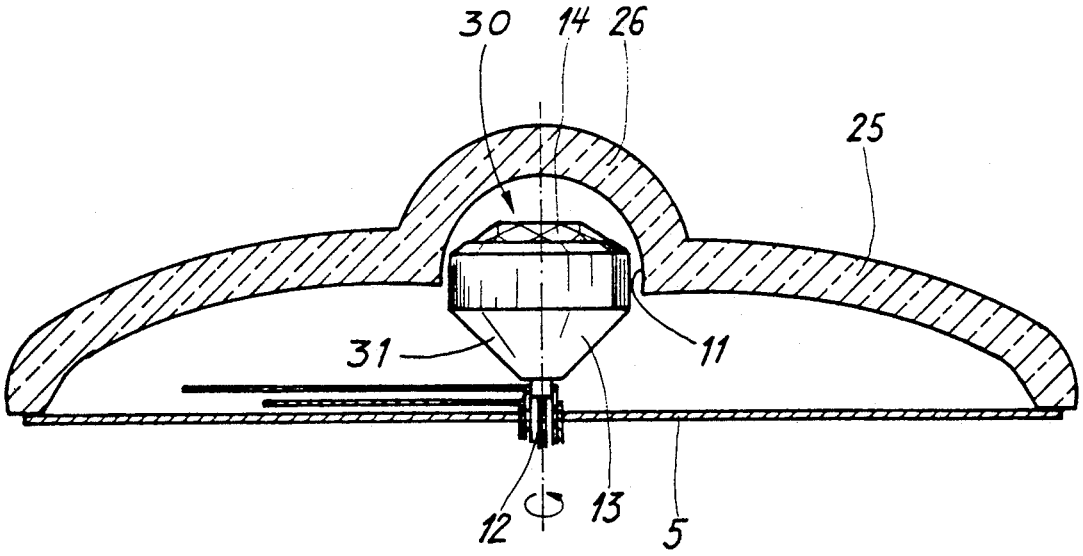
FIG. 3 shows a third embodiment of the invention.

FIG. 3 shows a third embodiment of the invention in which the protective wall 11 is formed by means of a blister 26 raised in crystal 25.

In the embodiments of FIGS. 2 and 3, the crystals 20, respectively 25 may be fixed to the caseband in the same manner as that described hereinabove with reference to FIG. 1.

It may be further mentioned that the seconds arbor may bear, in addition to the decorative pattern, a seconds hand such as is shown in the patent document CH-B-658 969 previously cited.

What we claim is:

1. An analog display timepiece provided with hands rotating between a dial and a first crystal and a decorative pattern fixed to an arbor for the hands and rotating therewith, said arbor emerging from said dial under said first crystal, said pattern exhibiting a substantially circular periphery located in a plane parallel to the dial, a fixed protective wall being arranged with clearance (x) around said periphery so as to limit the displacement of the pattern when a shock is applied to the timepiece.

2. A timepiece as set forth in claim 1 wherein the decorative pattern is a stone pressed into a setting, said setting being fixed to the seconds arbor.

3. A timepiece as set forth in claim 1 in which the protective wall is a bore formed in a second crystal arranged between the dial and the first crystal.

4. A timepiece as set forth in claim 1 wherein the protective wall comprises a blister raised in the first crystal.

5. A timepiece as set forth in claim 1 wherein the protective wall comprises a tube arranged under the first crystal and integrally formed therewith.

* * * * *